US009072389B2

(12) United States Patent
Lorenz

(10) Patent No.: US 9,072,389 B2
(45) Date of Patent: Jul. 7, 2015

(54) BRACKET FOR A SLAT IN A SLATTED BEDFRAME

(71) Applicant: Lorenz Kunststofftechnik GmbH, Wallenhorst (DE)

(72) Inventor: Thomas Lorenz, Wallenhorst (DE)

(73) Assignee: LORENZ KUNSTSTOFFTECHNIK GMBH, Wallenhorst (DE)

( * ) Notice: Subject to any disclaimer, the term of this patent is extended or adjusted under 35 U.S.C. 154(b) by 0 days.

(21) Appl. No.: 13/947,153

(22) Filed: Jul. 22, 2013

(65) Prior Publication Data

US 2014/0173824 A1 Jun. 26, 2014

(30) Foreign Application Priority Data

Jul. 24, 2012 (DE) ..... 20 2012 102 775 U

(51) Int. Cl.
*A47C 23/06* (2006.01)
*A47C 23/00* (2006.01)

(52) U.S. Cl.
CPC ..... *A47C 23/062* (2013.01); *A47C 23/061* (2013.01)

(58) Field of Classification Search
CPC ..... A47C 23/06; A47C 23/061; A47C 23/062
USPC ..... 5/238, 239, 241, 236.1, 237, 613
See application file for complete search history.

(56) References Cited

U.S. PATENT DOCUMENTS

| | | | | | |
|---|---|---|---|---|---|
| 128,175 | A * | 6/1872 | Secomb | 5/237 |
| 134,614 | A * | 1/1873 | Secomb | 5/240 |
| 188,478 | A * | 3/1877 | Ogborn et al. | 5/242 |
| 316,335 | A * | 4/1885 | Crowther | 5/238 |
| 320,741 | A * | 6/1885 | Abrams | 5/238 |
| 386,022 | A * | 7/1888 | Martin | 5/238 |
| 438,722 | A * | 10/1890 | Wilson | 5/238 |
| 474,018 | A * | 5/1892 | Laliberte | 5/238 |
| 614,820 | A * | 11/1898 | Anderson | 5/238 |
| 746,211 | A * | 12/1903 | Webb | 5/238 |
| 797,011 | A * | 8/1905 | Mosier | 5/238 |
| 3,176,323 | A * | 4/1965 | Degen | 5/238 |
| 3,588,930 | A * | 6/1971 | Frisell | 5/238 |
| 4,222,134 | A * | 9/1980 | Degen | 5/191 |
| 4,703,526 | A * | 11/1987 | Degen | 5/237 |
| 5,052,063 | A * | 10/1991 | Elmalek et al. | 5/238 |
| 5,127,114 | A * | 7/1992 | Horburger | 5/239 |
| 6,305,038 | B1 * | 10/2001 | Elkhuizen et al. | 5/241 |
| 7,861,333 | B2 * | 1/2011 | Grossman et al. | 5/37.1 |
| D649,016 | S * | 11/2011 | Rasmussen | D8/354 |
| 2009/0025142 | A1 * | 1/2009 | Grossman et al. | 5/37.1 |
| 2014/0173824 | A1 * | 6/2014 | Lorenz | 5/238 |
| 2014/0201908 | A1 * | 7/2014 | Lorenz | 5/238 |

FOREIGN PATENT DOCUMENTS

| | | | | |
|---|---|---|---|---|
| DE | 3230494 A1 * | 2/1984 | | A47C 23/06 |
| DE | 3506027 A1 * | 1/1986 | | A47C 23/06 |

* cited by examiner

*Primary Examiner* — Robert G Santos
(74) *Attorney, Agent, or Firm* — Patricia M. Mathers

(57) ABSTRACT

A bracket and spring slat for a slatted bed frame. The bracket has plugs that extend into slots on the spring slat and also a bearing stub that is insertable into a recess on the frame. The slots accommodate a spring action of the slats. The bracket and spring slat combination allow slats to be placed very close together in areas of heavy loading.

10 Claims, 2 Drawing Sheets

BRACKET FOR A SLAT IN A SLATTED BEDFRAME

BACKGROUND INFORMATION

1. Field of the Invention

The invention relates to the field of slatted bed frames. More particularly, the invention relates to a bracket for securing a spring slat to a slatted base frame.

2. Discussion of the Prior Art

In beds with a slatted bed base, the slats may provide a spring function. Such spring slats are connected to the frame of the slatted base by inserting each of the two ends of the spring slat into cap-like mounting brackets. These mounting brackets are arranged on the opposing long sides of the frame of a slatted base and are open on the face that is toward the middle of the frame, so that the ends of the spring slat may be inserted into the brackets.

A disadvantage of the conventional method of securing slats in a slatted base frame is that the mounting bracket has to be wider than the slats and that, therefore, the slats must be placed a minimum distance apart that corresponds to the dimension of the mounting bracket that is wider than the slat.

BRIEF SUMMARY OF THE INVENTION

The object of the invention is to improve on the conventional mounting bracket, such that two adjacent spring slats may be placed closer together.

The invention proposes not to surround the spring slat with the mounting bracket, but rather, to insert the mounting bracket into a plug opening in the spring slat and, in this way, to fasten the spring slat to the mounting bracket. The mounting bracket may now be constructed to be either narrower or the same width as the spring slat, without protruding beyond the width of the spring slat, thus making it possible to arrange two adjacent spring slats very close together.

It is now possible, in some areas of the slatted base where an especially strong support is desired, to arrange the spring slats more densely, that is, closer to one another, without having to use special spring slats, for example, harder spring slats, to achieve this greater support. Instead, the same type of spring slats may be used in the entire slatted base and the spring slats may be arranged particularly close together only in the area where greater support is desired.

The mounting bracket according to the invention may be constructed as a comparatively narrow piece, which means that the manufacturing costs may be lower than those for a larger mounting bracket that surrounds the spring slat. As a consequence, the mounting bracket as proposed may be produced quite economically.

Advantageously, the plug opening may be constructed to extend through the spring slat, that is, through the entire material thickness of the spring slat, so that a mounting bracket may be used that has a plug that extends through the entire spring slat. Thus, for example, plugs that widen upwards like mushrooms may be used, so that a proper snap-on connection between plug and slat may be achieved, thereby securing the spring slat against forces that tend to push it away from the plug. Pushing the plug all the way through the spring slat also enables a quick visual check to confirm that the spring slat is correctly fastened to the mounting bracket. Furthermore, the spring slat may be produced very economically, because blind bores created with an undercut are no longer necessary, if plugs having mushroom-like contours are to be used.

Advantageously, two or more plug openings may be arranged adjacent one another across the width of the spring slat, for example, directly next to each other, or may be offset with respect to the length of the spring slat. In any case, having several plug openings next to each other over the width of the spring slat increases the amount of opening in the surface of the spring slat, which facilitates optimum sleeping comfort due to the good ventilation of a mattress that lies on such spring slats in the slatted base.

If two plug openings are provided next to each other, the mounting bracket may, advantageously, also be equipped with two plugs, so that a plug extends into each of the two plug openings. This ensures correct positioning of the spring slat, when connecting the slat to the bracket in the course of assembling the slatted base. If the mounting bracket were to have only one single plug, then it would be possible to use the wrong opening of the two plug openings, which would place the spring slat in misalignment.

Advantageously, the spring slat on the mounting bracket may be moveable, so that, for example, the spring slat is able deflect downward, depending upon the weight being exerted on the spring slat. In an unloaded state, the spring slats are normally arranged in the slatted base with an upward curve. When pushed into a downward curve, considerable tractive force would be exerted on the mounting bracket, if the connection between the spring slat and the mounting bracket did not allow for relative movement. In order to construct the mounting bracket as inexpensively as possible and to rid it as much as possible from such stresses, the plug opening may be constructed to extend beyond the length plug in the longitudinal direction of the spring slat, toward the end of the spring slat.

Advantageously, movement of the slat relative the mounting bracket may be restricted in the opposite direction, that is, in case of an upward deflection of the slat. This is achieved by providing a stop limit in the plug opening in the direction toward the middle of the spring slat, so as to prevent a relative movement between the plug opening and the plug. When a number of spring slats are arranged on the frame, these stops in the spring slats ensure that all spring slats are centered on the frame. This gives, first of all, a good optical impression of the slatted frame, and, secondly, it facilitates assembling the slatted base into a bedframe, because hindrances, such as, spring slats that project too far and overhang the bedframe, are avoided.

Characteristic of the mounting bracket according to the invention is a plug is retained in a plug opening of a spring slat, and that the spring slat is fastened to the mounting bracket in this way.

The mounting bracket may be manufactured very inexpensively as a plastic injection-molded part. The entire mounting bracket may be made entirely of the same material. Alternatively, however, the mounting bracket may be manufactured using the so-called two-component or multi-component injection molding process. In such a case, the mounting bracket may have rigid and flexible areas made of two or more different materials.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

Figure 1:
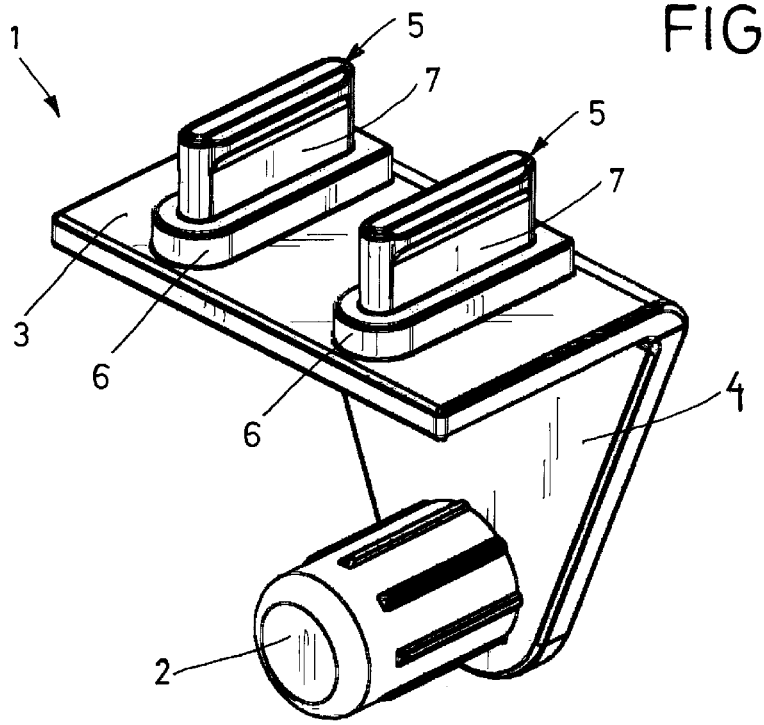
FIG. 1 is a perspective view of a mounting bracket.

FIGS. 1-5 show a mounting bracket 1 comprising a mounting plate 4 and a base plate 3. Slat connectors 5 are mounted on the base plate 3 and a bearing stub 2 that is insertable into a recess that is provided on the frame of the slatted base (not shown) is provided on the mounting plate 4. When the mounting bracket 1 is fitted onto the slatted base frame, the base plate 3 then lies on the top surface of the base frame.

It is understood that the construction of the mounting bracket 1 may have to be adapted to the slatted base frame, depending on the particular construction of the slatted base frame. So, for example, instead of the bearing stub 2 that is shown in the figures, differently constructed fastening means may be provided. It may also be possible to eliminate the connecting plate 4, if, for example, the mounting bracket 1 is to be fastened directly to the top side of the base frame. In that case, a bearing stub constructed similarly to the bearing stub 2 may be provided on the underside of the base plate 3, so that it extends downward from the base plate 3.

Two plugs 5 are arranged on the base plate 3. These plugs 5 extend upward from respective plug bases 6 that are mounted or formed on the base plate 3. The plug bases 6 serve to optimally support the plug 5 against shear forces. A rib 7 is provided on an upper area of the plug 5, on the long side, so that the plug 5 has a comparatively wide head region, to provide a forced fit in the spring slat, to secure it against forces working to lift the slat off the plug. The material for the plug 5 has a certain elasticity, which enables it to be insertable through a plug opening in the spring slat that is narrower than the head region on the plug.

In the shown embodiment, the mounting bracket 1 is as a single injection-molded plastic piece. Thus, the head region with the ribs 7, the entire plug 5 including the socket 6, and the entire mounting bracket 1 are made of the same material. Alternatively, however, the mounting bracket 1 may be produced in a well-known manner using the so-called two-component or multi-component injection molding. In this case, the mounting bracket 1 may have rigid and flexible regions made of two or more different materials, so that the head region with the ribs 7, for example, may be made to be more flexible than the socket 6.

The plugs 5 may also be constructed in a way that deviates from the shown embodiment. For example, the plug 5 may have a round cross section instead of an oblong one, and two or more plugs may be arranged in a row, that is, one behind the other in the longitudinal direction of the spring slat that is to be secured.

Figure 2:
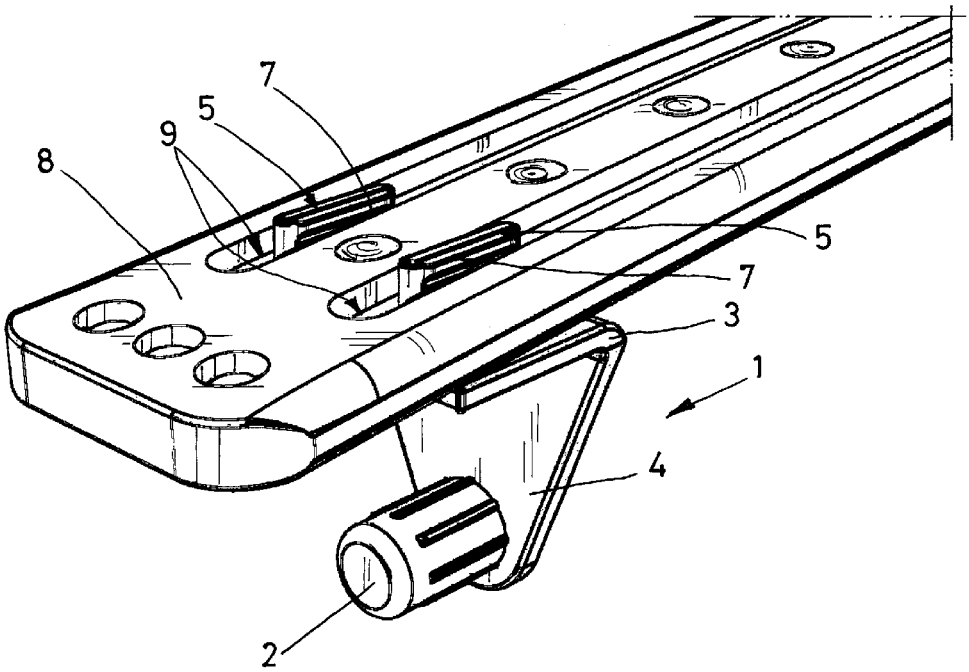
FIG. 2 shows the mounting bracket with a spring slat fastened to it.
Figure 3:
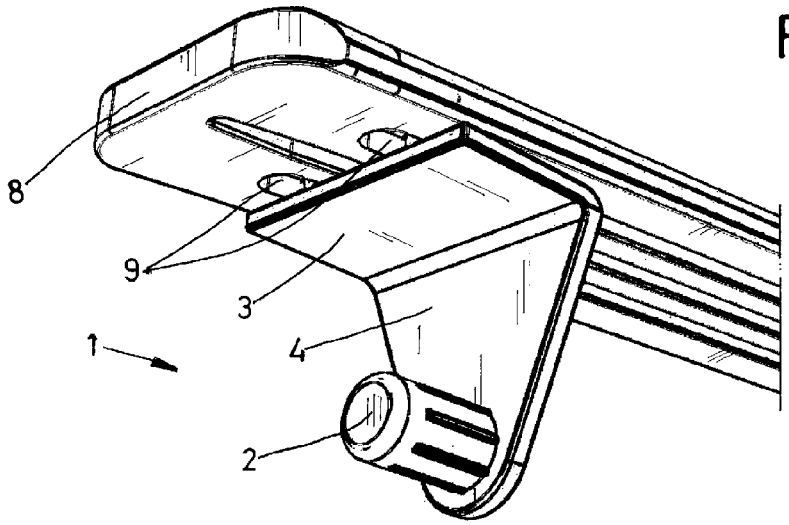
FIG. 3 is a bottom perspective view of the mounting bracket and spring slat of FIG. 2.

FIGS. 2 and 3 are top and bottom views, respectively, that show a spring slat 8 fastened to the mounting bracket 1. The two plugs 5 extend into two oblong plug openings 9 of the spring slat 8 that are constructed as slots 10. The bottom view shows that the plug openings 9 on the bottom side of the spring slat 8 widen into a larger cross section that is adapted to the measurements of the sockets 6, so that the sockets 6 are received into these wider cross-sectional areas. One also sees that the two plug openings 9, including the expanded cross-sectional areas, extend beyond the plugs 5 in the direction of the end of the spring slat 8. This allows a relative movability between the spring slat 8 and the mounting bracket 1, so that it is possible to guide the end of the spring slat 8 closer to the mounting bracket 1.

Further movement of the spring slat 8 in relation to the mounting bracket 1 is not possible, however, in the opposite direction. The expanded lower cross sections of the plug openings 9 are limited in length and are shorter than the aforementioned slots 10, so that they create a stop that limits further movement plug bases 6 when the spring slat 8 is moved relative to the mounting bracket 1 in such a direction that the gap between the end of the spring slat 8 that is visible in the drawings and the mounting bracket 1 increases. These ends of the expanded cross-sectional areas of the plug openings 9, which form the stop, are hidden from view in FIG. 3 by the mounting bracket 1.

Figure 4:
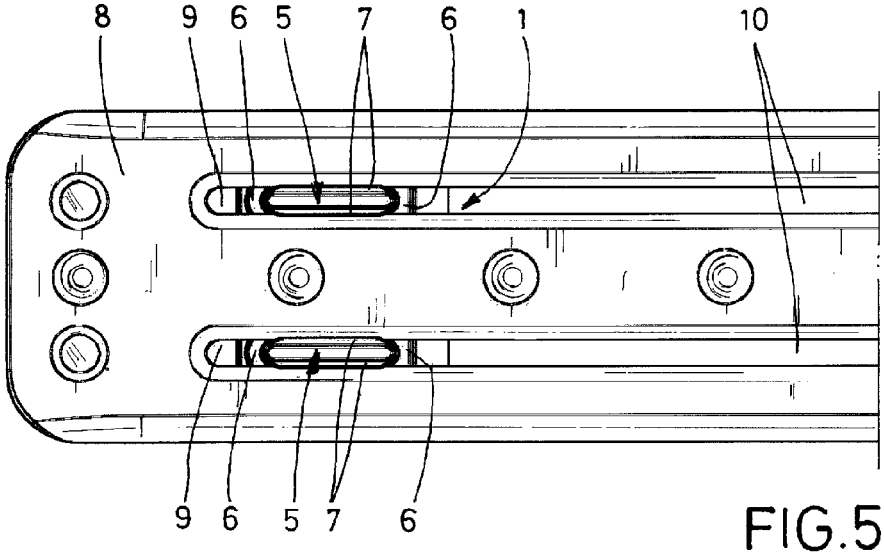
FIG. 4 is a top plan view of the spring slat mounted on the mounting bracket.

FIG. 4 shows that the plug openings 9 are constructed as a part of longer ventilation slots 10 and that the plug bases 6 have a rounded contour on the side that faces the end of the spring slat 8, and a straight contour on the opposite end that faces toward the middle of the spring slat 8.

Figure 5:
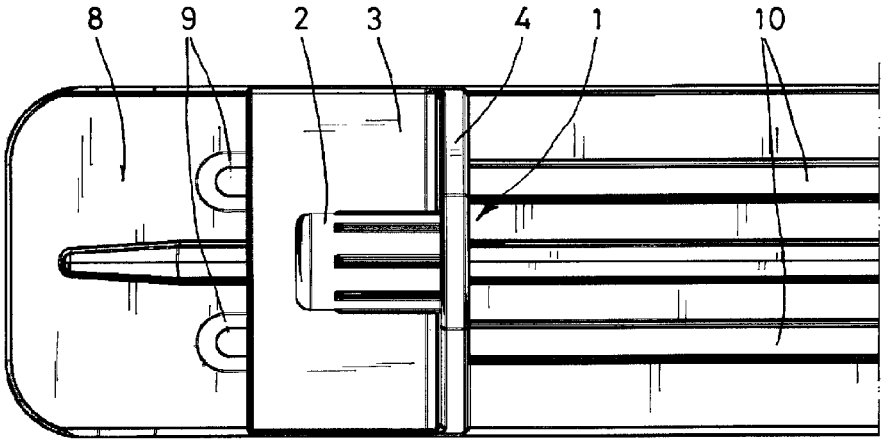
FIG. 5 is a bottom plan view of the spring slat and mounting bracket.

FIG. 5 is a bottom plan view that shows the contours of the plug openings 9 that are expanded on the bottom side, these openings 9 being adapted to the dimensions of the sockets 6.

The invention claimed is:

1. A system for securing a spring slat to a slatted bedframe, the system comprising:

a bracket having a first surface and a second surface, the first surface having at least one plug that includes a plug head extending upward from a plug rib, which in turn extends upward from a plug base, the plug base being wider than the plug rib and the plug rib wider than the plug head, and the second surface extending at a right angle to the first surface and having a bearing stub that extends orthogonal to the second surface and parallel to the first surface; and a spring slat having at least one plug opening to accommodate the at least one plug.

2. The system of claim 1, wherein the plug opening extends through the spring slat.

3. The system of claim 1, wherein two or more plug openings are provided next to each other across a width of the spring slat.

4. The system of claim 3, wherein two plugs are provided on the first surface of the bracket, each plug being insertable into a separate one of the plug openings on the spring slat.

5. The system of claim 1, wherein the plug is constructed to extend lengthwise in a length direction of the spring slat; and wherein the at least one plug opening on the spring slat is formed as an oblong slot.

6. The system of claim 1, wherein the plug opening in the spring slat has a lengthwise dimension greater than a lengthwise dimension of the at least one plug; and wherein, when the at least one plug is inserted into the plug opening, the plug opening extends beyond the at least one plug toward an end of the spring slat.

7. The system of claim 1, wherein the plug opening on an end extending toward the center of the spring slat is bounded by a stop that limits the movement of the at least one plug.

8. The system of claim 1, wherein the spring slat has a slat width dimension and the bracket has a bracket width dimension, and wherein the bracket width dimension is narrower or equal in width to the slat width dimension.

9. The system of claim 1, wherein the bracket is a molded component and the at least one plug and bearing stub are integral components of the molded component.

10. A bracket for mounting a spring slat to a slatted bedframe, the bracket comprising:

a first surface on which are provided one or more plugs, each plug including a plug head extending upward from a plug rib, which in turn extends upward from a plug base, the plug base being wider than the plug rib and the plug rib being wider than the plug head; and a second surface that extends at a right angle to the first surface and on which is provided a bearing stub that extends orthogonal to the second surface and parallel to the first surface;

wherein the bracket is removably fastenable to the spring slat by means of the at least one plug and to a frame board of the slatted bedframe by means of the bearing stub, so as to reliably fasten the spring slat to the slatted bedframe.

* * * * *